United States Patent [19]

Rippelmeyer

[11] 4,306,853

[45] Dec. 22, 1981

[54] DIRECT IGNITION GAS BURNER CONTROL SYSTEM WITH DIODE STEERING CIRCUITRY

[75] Inventor: Dennis M. Rippelmeyer, Waterloo, Ill.

[73] Assignee: Emerson Electric Co., St. Louis, Mo.

[21] Appl. No.: 121,371

[22] Filed: Feb. 14, 1980

[51] Int. Cl.[3] ..... F23N 5/00

[52] U.S. Cl. ..... 431/66; 431/67; 431/254

[58] Field of Search ..... 431/66, 67, 71, 254, 431/28

[56] References Cited

U.S. PATENT DOCUMENTS 3,933,419 1/1976 Romanelli ..... 431/66

4,265,612 5/1981 Romanelli et al. ..... 431/66

*Primary Examiner*—Edward G. Favors

*Attorney, Agent, or Firm*—Paul A. Becker, Sr.

[57] ABSTRACT

A gas burner control system includes a main burner, two electrically controlled valves connected fluidically in series with the burner, an electrical resistance igniter, a temperature responsive switch, and a diode steering circuit for controlling energizing of the valve windings and the igniter. The connected polarities of the diodes in the steering circuit are such that the winding of the first valve is energized by the alternating current power source when the source is of one polarity and the winding of the second valve is energized by the source when the source is of the opposite polarity.

6 Claims, 1 Drawing Figure

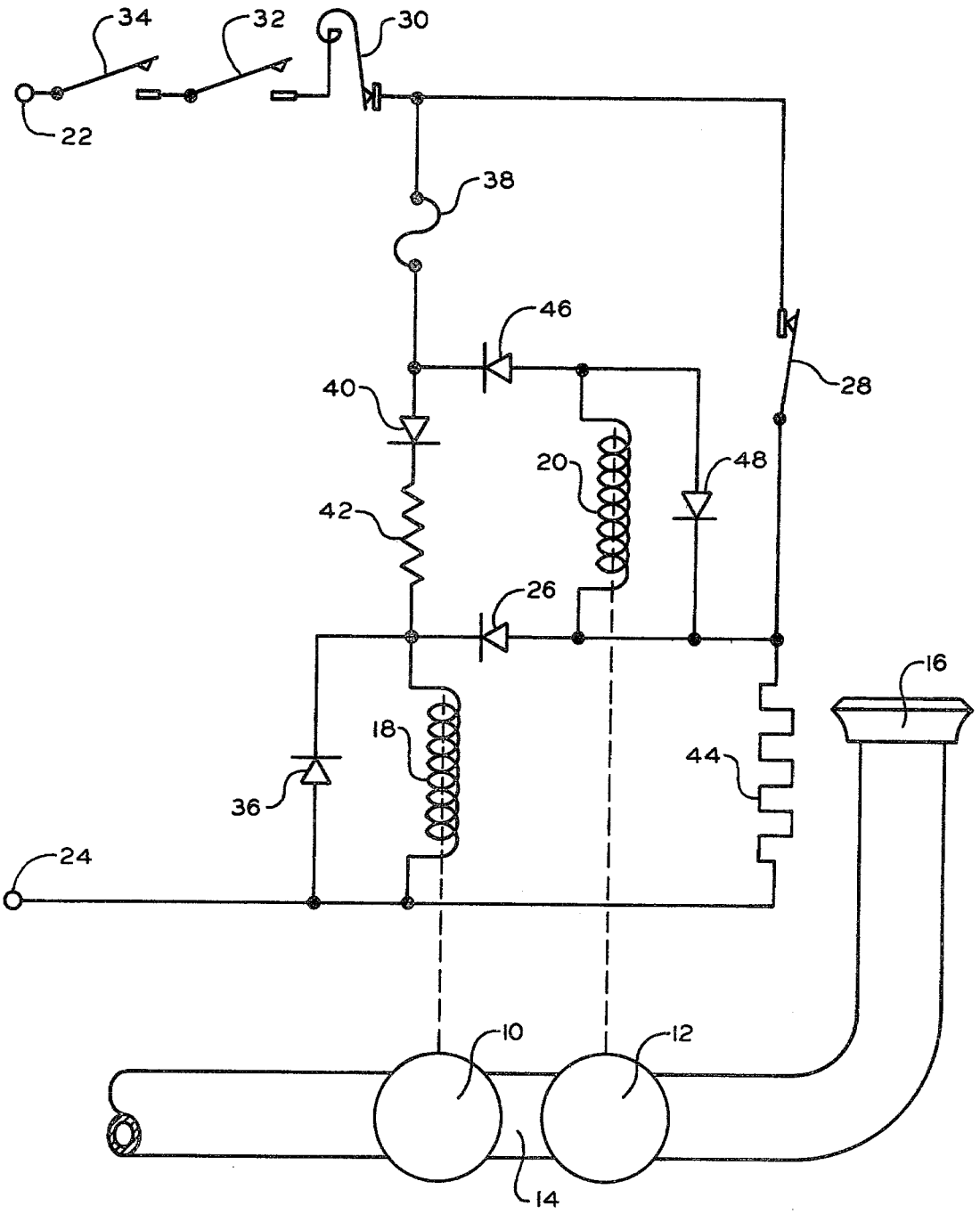
34
32
30
22
38
46
28
40
20
48
42
26
16
18
44
36
24
10
12
14

DIRECT IGNITION GAS BURNER CONTROL SYSTEM WITH DIODE STEERING CIRCUITRY

This invention relates to electrically operated gas burner control systems utilizing an electrical resistance igniter to directly ignite this main burner, and particularly to such direct ignition control systems utilized in clothes dryers.

The prior art shows various arrangements for providing direct ignition of a main gas burner by an electrical resistance igniter. Such arrangements generally include the igniter, switch means responsive to igniter temperature and burner flame, and valve means for controlling the flow of gas to the burner.

While some prior art systems utilize a single valve to control the flow of gas to the burner, it has been and continues to be generally desirable to utilize two gas valves connected fluidically in series with the burner. Such an arrangement provides an additional safety factor, as compared to the single-valve arrangement, in that gas will not leak to the burner if one valve fails to close completely, due to, for example, dirt or other foreign matter on its valve seat.

Prior art systems utilizing the two-valve arrangement generally provide a desired sequence of burner operation, the sequence being: the igniter is energized and heats up, and the temperature responsive sensor switch responds to the igniter being at or above gas ignition temperature to effect flow of gas to the burner. However, such prior art systems are generally quite complex in either the electrical circuitry or components. For example, various prior art systems use a complex sensor switch, or a switch means in addition to the sensor switch, or an electrical winding construction on one or both of the valves that is very critical as to its electrical impedance characteristics. Typical of such prior art systems are those shown in U.S. Pat. Nos. 3,589,846; 3,597,139; 3,603,708; 3,620,659; and 3,807,933.

An object of this invention is to provide a generally new and improved direct ignition gas burner control system of the type utilizing two electrically controlled valves connected fluidically in series with the burner, an electrical resistance igniter for igniting the gas, and a sensor switch responsive to igniter temperature and burner flame, wherein a plurality of diodes is effective to control energizing of the igniter and of electrical windings controlling the gas valves.

A further object is to provide a control system as in the preceeding paragraph wherein each gas valve has a single electrical winding, and wherein a diode steering circuit is effective to provide separate energizing circuits for each winding so as to minimize the criticality of the impedance values of the valve windings.

Yet a further object of this invention is to provide a generally new and improved direct ignition gas burner control system which is particularly simple in operation and relatively inexpensive to manufacture.

These and other objects and advantages of the present invention will become apparent from the following description when read in connection with the accompanying drawing.

The single FIGURE of the drawing is a schematic illustration of a gas burner control system constructed in accordance with the present invention.

DESCRIPTION OF THE PREFERRED EMBODIMENT

Referring to the drawing, gas valves 10 and 12 are connected fluidically in series in gas conduit 14 leading from a gas source (not shown) to a burner 16. An electrical winding 18 controls energizing of valve 10, and an electrical winding 20 controls energizing of valve 12. It is to be understood that valves 10 and 12 can be solenoid operated valves, wherein windings 18 and 20 are the respective solenoid coil windings, or valves 10 and 12 can be combined into a so-called manifold valve, wherein valve 10 is a solenoid operated valve controlled by winding 18 and valve 12 is a pressure operated valve controlled by electrical winding 20 of a relay coil in a servo system.

Electrical winding 18 is connected to terminals 22 and 24 of a conventional 120 volt alternating current power source through a valve pull-in circuit comprising a diode 26 and a sensor switch 28, a thermostat switch 30, a dryer door-switch 32, and a timer-actuated switch 34. When source terminal 22 is positive and switches 28, 30, 32, and 34 are closed, diode 26 conducts, enabling electrical winding 18 to be energized to effect opening of gas valve 10. A diode 36 is connected across winding 18 in opposite polarity to diode 26 and is effective, when source terminal 22 is negative, to permit continued flow of current through winding 18, due to the winding inductance thereof, so as to enable valve 10 to remain open.

Connected in series with each other and in parallel with series-connected diode 26 and sensor switch 28 are a fuse 38, a diode 40, and a resistor 38 comprising a valve hold-in circuit for winding 18. The cathode of diode 40 is connected through resistor 42 to the cathode of diode 26 so as to provide the same direction of current flow through winding 18 as that provided through diode 26. When sensor switch 28 is open and terminal 22 is positive, electrical winding 18 is sufficiently energized through switches 30, 32, and 34, fuse 38, diode 40, and resistor 42 to enable valve 10 to remain open, but because of the reduced current flow through winding 18 due to the resistance value of resistor 42, is insufficiently energized to enable valve 10 to open from a closed position. Diode 36 is effective to permit valve 10 to remain open when terminal 22 is negative.

Electrical winding 20, controlling valve 12, is connected to power source terminals 22 and 24 in series with an electrical resistance igniter 44, a diode 46, fuse 38, and switches 30, 32, and 34, diode 46 being connected in opposed polarity to diodes 26 and 40. Sensor switch 28 is electrically connected in parallel with series-connected winding 20, diode 46, and fuse 38 so that when the sensor switch 28 is closed, winding 20 is shunted by switch 28 and cannot be energized. When sensor switch 28 is open and terminal 22 is negative, diode 46 conducts, enabling electrical winding 20 to be energized through igniter 44, diode 46, fuse 38, and switches 30, 32, and 34 to effect opening of valve 12. A diode 48 is connected in parallel with electrical winding 20 and in opposite polarity to diode 46, and is effective, when source terminal 22 is positive, to enable valve 12 to remain open.

It is noted that while it is preferred to utilize diodes 36 and 48 to maintain energizing of windings 18 and 20, respectively, such function could also be provided by other means, such as by capacitors.

Electrical resistance igniter 44, preferably a silicon-carbide device having a negative coefficient of temperature, requires a predetermined current flow therethrough to enable it to attain a temperature sufficiently high to ignite gas. This predetermined current flow can only be achieved when sensor switch 28 and switches 30, 32 and 34 are closed, enabling essentially the entire source voltage at terminals 22 and 24 to be applied to igniter 44 during both half cycles of the alternating current power source.

The temperature responsive sensor switch 28, preferably a bimetallic device, is disposed with respect to igniter 44 so as to respond to the radiant energy thereof. Sensor switch 28 opens when igniter 44 reaches or slightly exceeds gas ignition temperature. When sensor switch 28 opens, igniter 44 is no longer sufficiently energized, as will be later described, and begins to cool down. Its mass, however, is sufficient to enable it to maintain, for a short time period, a temperature sufficient to ignite gas.

As will be described in more detail later, when sensor switch 28 opens, gas flows to burner 16 and is ignited by igniter 44. Sensor switch 28 is disposed with respect to burner 16 so as to be maintained in an open position by the radiant energy of the burner flame.

OPERATION

In the absence of burner flame and with igniter 44 de-energized, sensor switch 28 and thermostat switch 30 are closed. To initiate a burner cycle, the timer (not shown) is adjusted to the desired length of time the dryer is to operate, resulting in the closing of timer-actuated switch 34, and the dryer door is closed, resulting in the closing of door-switch 32. With switches 28, 30, 32, and 34 closed, essentially the entire source voltage at terminals 22 and 24 appears across igniter 44, the resistance of switches 28, 30, 32, and 34 being negligible. Igniter 44 is energized by both half cycles of the alternating current power source and rapidly heats.

Concurrently, winding 18 of valve 10 is energized through switches 28, 30, 32, and 34, and diode 26, when power source terminal 22 is positive, to cause valve 10 to open. When source terminal 22 is negative, the half cycle during which diode 26 does not conduct, diode 36, in parallel with winding 18, enables winding 18 to remain energized. With valve 10 open, gas flows through valve 10 but cannot flow to burner 16 due to valve 12 being closed.

When igniter 44 reaches or preferably slightly exceeds a temperature sufficient to ignite gas, sensor switch 28 opens in response to the radiant energy emitted by igniter 44. With sensor switch 28 open, electrical winding 20 of valve 12 is energized through igniter 44, diode 46, fuse 38, and switches 30, 32, and 34 when power source terminal 22 is negative. When power source terminal 22 is positive, the half cycle during which diode 46 does not conduct, winding 20 remains energized due to diode 48 which is connected in parallel with winding 20. Energizing of winding 20 enables valve 12 to open, allowing gas to flow to burner 16.

When sensor switch 28 opens, the power level at which igniter 44 is energized is reduced considerably. Specifically, with sensor switch 28 open, igniter 44 is energized through winding 20, diode 46, fuse 38, and switches 30, 32 and 34. Under this condition, igniter 44 is energized only during the half cycles when diode 46 conducts, and is energized at a reduced level since igniter 44 is in series with winding 20. However, due to its mass, igniter 44 remains at or slightly above gas ignition temperature, after sensor switch 28 opens, for a sufficient time period to ignite gas at burner 16.

Also occurring when sensor switch 28 opens is a reduction in the level of energizing of winding 18 of valve 10 to a level sufficient to maintain valve 10 open but insufficient to open it from a closed position. Specifically, when sensor switch 28 opens, energizing of winding 18 through sensor switch 28 and diode 26 ceases, and winding 18 is subsequently energized through fuse 38, diode 40, and resistor 42. During the half cycles when diode 40 is not conducting, diode 36, connected in parallel with winding 18, is effective to maintain winding 18 energized at this reduced level.

It is noted that when sensor switch 28 is open, winding 18 is energized through diode 40 and resistor 42 when source terminal 22 is positive, and igniter 44 is energized, at a reduced level, through winding 20 and diode 46 when source terminal 22 is negative. Under these conditions, diode 26 does not conduct, so that the voltage across winding 18 is not determined by the voltage across igniter 44.

When the gas at burner 16 is ignited, sensor switch 28 is responsive to the radiant energy emitted by the burner flame to remain open. The burner 16 remains on until at least one of the switches 30, 32, and 34 are opened, or until there is an interruption of electrical power at power source terminals 22 and 24.

When one of the switches 30, 32, and 34 is opened, or when electrical power at terminals 22 and 24 is interrupted, electrical windings 18 and 20 are immediately de-energized, causing valves 10 and 12 to immediately close, and igniter 44 is de-energized. The absence of burner flame enables sensor switch 28 to cool and eventually close.

Timer-actuated switch 34 opens when the normal drying cycle is completed. Thermostat switch 30 opens when the temperature of the heated air or the products of combustion, or both, exceed a predetermined temperature. When burner operation is terminated by opening of switch 34 or 30, the sensor switch 28 generally has sufficient time to cool and close so that, upon reclosing of switch 34 or 30, a normal burner cycle as previously described is initiated.

When, however, burner operation is prematurely terminated by opening of dryer door-switch 32 or by an electrical power interruption at power source terminals 22 and 24, sensor switch 28 may still be open when switch 32 is reclosed or power is restored, respectively. When switch 32 is reclosed or power is restored before sensor switch 28 closes, winding 20 of valve 12 is energized to effect opening of valve 12, but winding 18 of valve 10, energized through resistor 42, is not sufficiently energized to effect opening of valve 10. Thus, no gas flows to burner 16. Also, since igniter 44 is energized through winding 20 at a level insufficient to enable it to attain gas ignition temperature, igniter 44 is also insufficiently heated to prevent sensor switch 28 from closing. Thus, sensor switch 28 continues to cool and eventually closes. When sensor switch 28 closes, a normal burner cycle as previously described is initiated.

The burner control system of this invention also provides for safe operation in the event of various circuit component failures. For example, if sensor switch 28 fails to open, electrical winding 20 of valve 12 remains shunted by sensor switch 28 and cannot be energized so that no gas flows to burner 16. If sensor switch 28 fails to close in the absence of burner flame, winding 18 of valve 10 is energized, when a subsequent burner cycle is initiated, through fuse 38, diode 40, and resistor 42 to a level sufficient to hold valve 10 open but insufficient to open valve 10 from a closed position, so that no gas flows to burner 16.

If igniter 44 has an open circuit, winding 20 of valve 12 cannot be energized since the only electrical connection for enabling energizing of winding 20 is through igniter 44. If igniter 44 is shorted, winding 18 of valve 10 is shunted by shorted igniter 44 so that valve 10 cannot open.

Fuse 38 is provided to ensure safe operation in the event that diode 46 should short. Specifically, shorted diode 46 would enable igniter 44 to be energized by essentially the entire voltage at terminals 22 and 24 during the half cycles that diode 48 conducts. This level of energizing could possibly cause igniter 44 to heat sufficiently to open sensor switch 28 and maintain it open even in the absence of burner flame. Fuse 38 is, therefore, effective to open and prevent such an unsafe condition. Fuse 38 is also effective to open should diode 40 or diode 48 short. Should diode 26 or diode 36 short, a fuse (not shown) in the power source would open.

Should any of the diodes have an open circuit, one or the other of windings 18 and 20 could not be energized. Specifically, if diode 46 opens, winding 20 cannot be energized; if diode 26 opens, winding 18 cannot be energized to open from a closed position; if diode 40 opens, winding 18 cannot be held in after sensor switch 28 opens; if diode 36 opens, winding 18 would not be sufficiently energized during the half cycles when source terminal 22 is negative; and if diode 48 opens, winding 20 would not be sufficiently energized during the half cycles when source terminal 22 is positive.

Utilization of diodes 26, 40 and 46 enables windings 18 and 20 to be energized in separate electrical circuits in that they are energized by opposite polarity half cycles of the alternating current power source. Specifically, winding 18 is initially energized through diode 26 and, after sensor switch 28 opens, is held in through diode 40, such energizing occurring when source terminal 22 is positive; and winding 20 is energized through diode 46, such energizing occurring when source terminal 22 is negative. With this arrangement, the respective winding impedances of windings 18 and 20 are considerably less critical than if the windings 18 and 20 were connected in series in the same circuit.

While the invention has been illustrated and described in detail in the drawings and foregoing description, it is recognized that many changes and modifications will occur to those skilled in the art. It is therefore intended, by the appended claims, to cover any such changes and modifications as fall within the true spirit and scope of the invention.

I claim:

1. In a gas burner control system wherein two electrically controlled valves are connected fluidically in series with a main burner, wherein an electrical resistance igniter is effective to ignite the burner, wherein a first of the two valves is opened through a pull-in circuit and the igniter is energized upon a call for heat, wherein a normally-closed temperature responsive switch is effective to open when the igniter is at gas ignition temperature, wherein the second valve is opened to allow gas to flow to the burner when the switch opens, wherein opening of the switch effects de-energizing of the igniter, wherein the igniter is of sufficient mass to remain at gas ignition temperature for a period of time sufficient to ignite the burner, wherein the switch is maintained open by burner flame, wherein the pull-in circuit for the first valve is de-energized when the switch opens, and wherein a hold-in circuit for the first valve is energized when the switch opens, the improvement comprising: diode steering circuit means for providing separate energizing circuits of opposite polarity for controlling operation of the two valves including a first diode for enabling energizing of the pull-in circuit of the first valve so as to enable said first valve to open, a second diode connected in opposed polarity to said first diode for enabling the second valve to open, and a third diode connected in the same polarity as said first diode for enabling energizing of the hold-in circuit of said first valve so as to enable said first valve to remain open.

2. In an electrically operated direct ignition gas burner control system of the type having first and second valves connected fluidically in series with a main burner and each valve having a controlling electrical winding, an electrical resistance igniter for igniting the burner, a normally-closed temperature responsive switch which opens when the igniter is at a temperature sufficient to ignite gas and is maintained open thereafter by burner flame, and the control system is adapted to be energized by an alternating current power source, the improvement comprising:

circuit means including a first diode, effective to conduct when one side of the alternating current power source is positive and when the switch is closed, for enabling sufficient energizing of the first valve winding to effect opening of the first valve;

circuit means including a second diode effective to conduct when the other side of said alternating current power source is positive and when said switch is open, for enabling sufficient energizing of the second valve winding to effect opening of the second valve;

circuit means including a third diode, effective to conduct when said one side of said alternating current power source is positive and when said switch is open, for enabling sufficient energizing of said first valve winding to maintain said first valve open;

circuit means connected across said first valve winding for maintaining energizing thereof when said other side of said alternating current power source is positive; and circuit means connected across said second valve winding for maintaining energizing thereof when said one side of said alternating current power source is positive.

3. In a direct ignition gas burner control system adapted to be energized by an alternating current power source and of the type having first and second valves connected fluidically in series with a main burner and each valve being controlled by an electrical winding, an electrical resistance igniter for igniting the burner, and a normally-closed sensor switch which opens when the igniter reaches gas ignition temperature and is maintained open thereafter by burner flame, an improved circuit arrangement for controlling energizing of the valve windings and igniter comprising:

a first diode connected in series with the sensor switch and the first winding;

a second diode connected in series with the second winding;

a third diode connected in series with a resistor and said first winding;

circuit connections connecting the igniter in series with said sensor switch across the alternating current power source, said igniter being energized, when said sensor switch is closed, during both half cycles of said alternating current power source;

circuit connections connecting said series connected first diode and first winding in parallel with said igniter, said first diode being connected with such polarity as to enable energizing of said first winding through said first diode only when said sensor switch is closed and one side of said alternating current power source is positive, circuit means connected in parallel with said first winding for enabling continued energizing thereof when said one side of said alternating current power source is negative;

circuit connections connecting said series connected second diode and second winding in parallel with said sensor switch, said second diode being connected with such polarity as to enable energizing of said second winding through said second diode and said igniter only when said sensor switch is open and the other side of said alternating current power source is positive;

circuit means connected in parallel with said second winding for enabling continued energizing thereof when said other side of said alternating current power source is negative; and circuit connections connecting said series connected third diode and resistor in parallel with said series connected first diode and sensor switch, said third diode being connected with such polarity as to enable a reduced level of energizing of said first winding through said third diode and said resistor only when said sensor switch is open and said one side of said alternating current power source is positive, said circuit means connected in parallel with said first winding being effective for enabling continued energizing thereof at said reduced level of energizing when said one side of said alternating current power source is negative.

4. In a direct ignition gas burner control system adapted to be energized by an alternating current power source, a burner;

first and second gas valves connected fluidically in series with said burner;

an electrical winding for each of said valves;

an electrical resistance igniter for igniting said burner;

a normally-closed temperature responsive switch which opens when said igniter is at a temperature sufficient to ignite gas and is maintained open thereafter by burner flame;

first, second, and third diodes;

a resistor;

first circuit connections connecting said switch, said first diode, and said first winding in series across the alternating current power source for effecting half wave energizing of said first winding when said switch is closed and one side of said alternating current power source is positive;

second circuit connections connecting said igniter in parallel with said series connected first diode and first winding for effecting full wave energizing of said igniter, when said switch is closed, to enable said igniter to attain said temperature sufficient to ignite gas;

third circuit connections connecting said second diode and said second winding in series with each other and connecting said series connected second diode and second winding in parallel with said switch for effecting half wave energizing of said second winding when said switch is open and the other side of said alternating current power source is positive;

fourth circuit connections connecting said third diode and said resistor in series with each other and connecting said series connected third diode and resistor in parallel with said series connected switch and first diode for effecting a reduced level of half wave energizing of said first winding when said switch is open and said one side of said alternating current power source is positive;

circuit means connected in parallel with said first winding for enabling continued energizing thereof when said one side of said alternating current power source is negative; and circuit means connected in parallel with said second winding for enabling continued energizing thereof when said other side of said alternating current power source is negative.

5. The control system claimed in claim 4 wherein said circuit means connected in parallel with said first winding comprises a fourth diode connected across said first winding in opposed polarity to said first and third diodes, and said circuit means connected in parallel with said second winding comprises a fifth diode connected across said second winding in opposed polarity to said second diode.

6. The control system claimed in claim 4 wherein, when said switch is open and said second winding is energized, said igniter is energized through said second winding and said second diode only when said other side of said alternating current power source is positive, such energizing being insufficient to enable said igniter to attain said temperature sufficient to ignite gas, said igniter having sufficient mass to remain at said temperature sufficient to ignite gas for a period of time sufficient to ignite said burner.

* * * * *